United States Patent [19]

Myers

[11] Patent Number: 4,817,149

[45] Date of Patent: Mar. 28, 1989

[54] THREE-DIMENSIONAL AUDITORY DISPLAY APPARATUS AND METHOD UTILIZING ENHANCED BIONIC EMULATION OF HUMAN BINAURAL SOUND LOCALIZATION

[75] Inventor: Peter H. Myers, San Jose, Calif.

[73] Assignee: American Natural Sound Company, Oroville, Calif.

[21] Appl. No.: 5,965

[22] Filed: Jan. 22, 1987

[51] Int. Cl.[4] ..... H04S 1/00

[52] U.S. Cl. ..... 381/1; 381/63

[58] Field of Search ..... 381/1, 62, 63, 98, 17

[56] References Cited

U.S. PATENT DOCUMENTS 4,060,696 11/1977 Iwahara et al. .
4,119,798 10/1978 Iwahara .
4,143,244 3/1979 Iwahara .
4,188,504 2/1980 Kasuga .
4,251,688 2/1981 Furner .

FOREIGN PATENT DOCUMENTS 0141898 11/1980 Japan ..... 381/1

OTHER PUBLICATIONS

Filters with an Arbitrary Response, Chapter appearing at pp. 452–465 of "Musical Application of Microprocessors" by Hal Chamberlin, 1985, Hayden.

"Spatial Hearing—The Psychophysics of Human Sound Localization", pp. 201–367, by Jens Blauert, 1983, MIT Press, Chapter, Spatial Hearing with Multiple Sound Sources and in Enclosed Spaces and Chapter, Progress and Trends since 1972.

A History of Binaural Sound, by John Sunier, Audio/-Mar. 1986.

Simulating the Cues of Spatial Hearing in Natural Environments, by Gary S. Kendall et al. of NorthWestern University, Evanston, Ill., 1984 ICMC External Ear Response and Sound Localization, by E. A. G. Shaw; R. W. Gatehouse, Editor, Localization of Sound Theory and Appl.

*Primary Examiner*—Forester W. Isen

*Attorney, Agent, or Firm*—Philip M. Shaw, Jr.

[57] ABSTRACT

An artificial, three dimensional auditory display which artificially imparts localization cues to a multifrequency component electronic signal which corresponds to a sound source. The cues imparted are a front to back cue in the form of attenuation and boosting of certain frequency components of the signal, an elevational cue in the form of severe attenuation of a selected frequency component, i.e. variable notch filtering, an azimuth cue by means of splitting the signal into two signals and delaying one of them by a selected amount which is not greater than 0.67 milliseconds, an out of head localization cue by introducing delayed signals corresponding to early reflections of the original signal, an environment cue by introducing reverberations and a depth cue by selectively amplitude scaling the primary signal and the early reflection and reverberation signals.

23 Claims, 7 Drawing Sheets

DIRECT SOUND

EARLY REFLECTIONS

LATER REVERBERATION

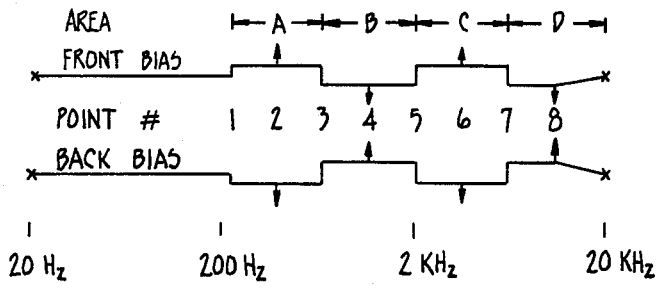
FIG._8.
| POINT # | ≈ FREQ. (Hz) |
|---|---|
| 1 | 225 |
| 2 | 392 |
| 3 | 682 |
| 4 | 1,188 |
| 5 | 2,069 |
| 6 | 3,605 |
| 7 | 6,279 |
| 8 | 10,938 |
FIG._9.
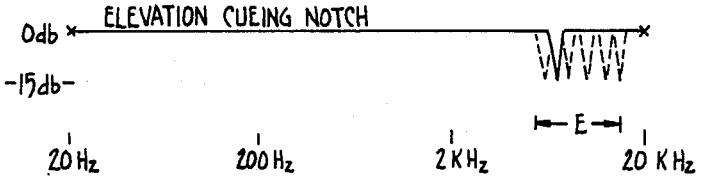
FIG._10.
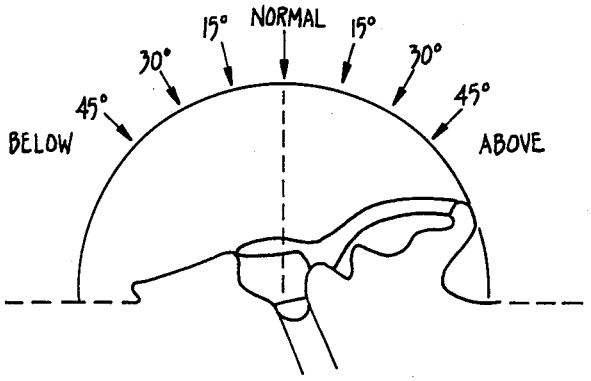
FIG._11.
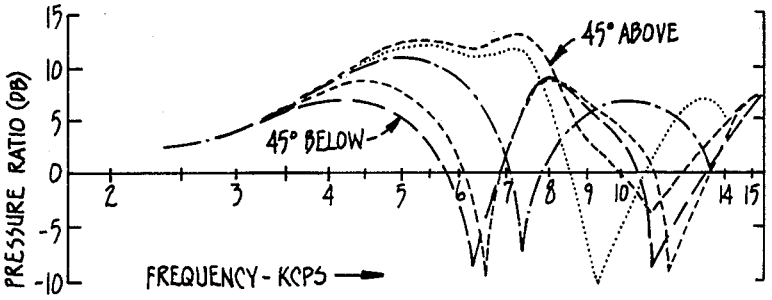
FIG._12.

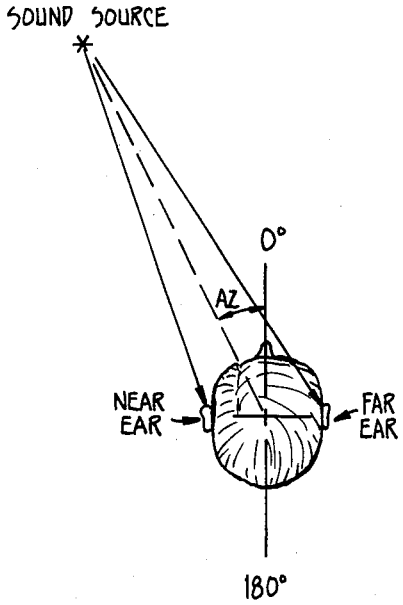
FIG._13.
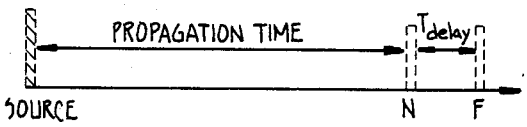
FIG._14.
| AZIMUTH (ELEVATION 0°) | T DELAY (IN SECONDS) |
|---|---|
| 0° | 0.0 |
| 30° | 0.000268 |
| 60° | 0.000501 |
| 90° | 0.000673 |
| 120° | 0.000501 |
| 150° | 0.000268 |
| 180° | 0.0 |
Az = AZIMUTH IN DEGREES (0°-180° RANGE)
El = ELEVATION IN DEGREES (± 90° RANGE)
FIG._15.
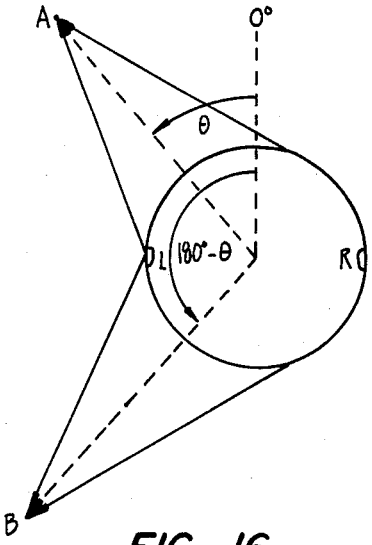
FIG._16.
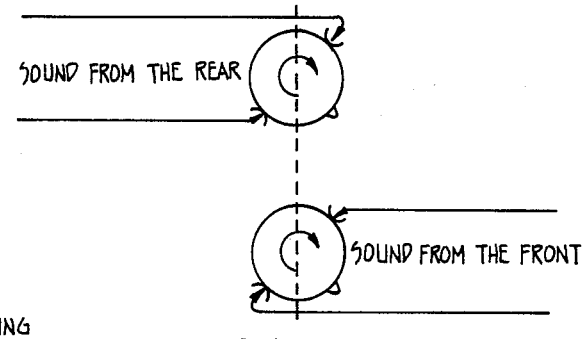
FIG._17.
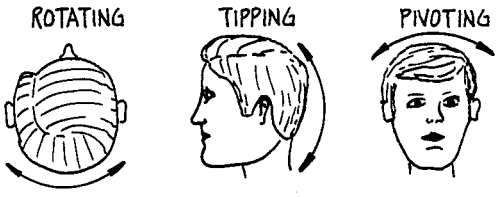
FIG._18.
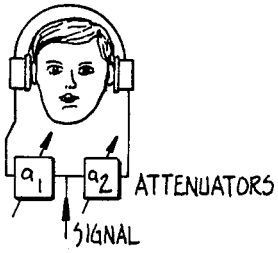
FIG._19.

THREE-DIMENSIONAL AUDITORY DISPLAY APPARATUS AND METHOD UTILIZING ENHANCED BIONIC EMULATION OF HUMAN BINAURAL SOUND LOCALIZATION

BACKGROUND OF THE INVENTION

1. Field of the Invention

The invention relates to circuits and methods for processing binaural signals, and more particularly to a method and apparatus for converting a plurality of signals having no localization information into binaural signals, and further, for providing selective shifting of the localization position of the sound.

2. Description of the Prior Art

Human beings are capable of detecting and localizing sound source origins in three-dimensional space by means of their binaural sound localization ability. Although binaural sound localization provides orders of magnitude less information in terms of absolute three-dimensional dissemination and resolution than the human binocular sensory system, it does possess unique advantages in terms of complete, three-dimensional, spherical, spatial orientation perception and associated environmental cognition. Observing a blind individual take advantage of his environmental cognition through the complex, three-dimensional spatial perception constructed by means of his binaural sound localization system, is convincing evidence in terms of exploiting the sensory pathway in order to construct an artificial, sensory-enhanced, three-dimensional auditory display system.

The most common form of sound display technology employed today is known as stereophonic or "stereo" technology. Stereo was an attempt at providing sound localization display, whether real or artificial, by utilizing only one of the many binaural cues needed for human binaural sound localization—interaural amplitude differences. Simply stated, by providing the human listener with a coherent sound independently reproduced on each side of the head, be it by loudspeakers or headphones, any amplitude difference, artificially or naturally generated between the two sides, will tend to shift the perception of the sound towards the dominantly reproduced side.

Unfortunately, the creators of stereo failed to understand basic human binaural sound localization "rules" and stereo fell far short of meeting the needs of the two eared system in providing artificial cuing to the listener's brain in an attempt to fool it into believing it is hearing three dimensional location of sounds. Stereo more often is denoted as producing "a wall of sound" spread laterally in front of the listener, rather than a three-dimensional sound display or reproduction.

A theoretical improvement on the stereo system is the quadraphonic sound system which places the listener in the center of four loudspeakers: two to the left and right in front, and two to the left and right in back. At best, "quad" provides an enhanced sensation over stereo technology by creating an illusion to the listener of being "surrounded by sound." Other practical disadvantages of "quad" over the present invention are the increased information transmission, storage and reproduction capabilities needed for a four channel system rather than the two required in stereo or the two channels required by the technologies of this invention.

Many attempts have been made at creating more meaningful illusions of sound positioning by increasing the number of loudspeakers and discrete locations of sound emanation—the theory being, the more points of sound emanation the more accurately the sound source can be "placed." Unfortunately, again this has no bearing on the needs of the listener's natural auditory system in disseminating correct localization information.

In order to reduce the transmission and storage costs of multiple loudspeaker reproduction, a number of technologies have been created in order to matrix or "fold in" a number of channels of sound into fewer channels. Among others, a very popular cinema sound system in current use utilizes this approach, again failing to provide true three-dimensional sound display for the reasons previously discussed.

Because of the practical considerations of cost and complexity of multiple loudspeaker displays, the number of discrete channels is usually limited. Therefore, compromise is further induced in such displays until the point is reached that for all practical purposes the gains in sound localization perception are not much beyond "quad." Most often, the net result is the creation of "surround sound" illusions such as are employed in the cinema industry.

Another form of sound enhancement technology available to the end user and claiming to provide "three-dimensionality and spatial enhancement," etc. is in delay line and artificial reverberation units. These units, as a norm, take a conventional stereo source and either delay or provide reverberation effects which are reproduced primarily from the rear of the listener over an additional pair (or pairs) of loudspeakers, the claimed advantage being that of placing the listener "within the concert hall."

Although sound enhancement technologies do construct some form of environmental ambience for the listener, they fall far short of the capability of three-dimensionally displaying the primary sounds so as to binaurally cue the listener's brain.

A good method of providing true, three-dimensional sound recordings and reproduction from within an acoustical environment is via binaural recording; a technique which has been known for over fifty years. Binaural recording utilizes a two channel microphone array that is contained within the shell of an anthropometric mannequin. The microphones are attached to artificial ears that mimic in every way the acoustic characteristics of the human external auditory system. Very often, the artificial ears are made from direct ear molds of natural human ears. If the anthropometric model is exactly analogous to the natural external auditory system in its function of generating binaural localization cues, then the "perception" and complex binaural image so generated can be reproduced to an listener from the output of the microphones mimicking the eardrums. The binaural image constructed by the anthropometric model, when reproduced to an listener by means of headphones and, to a lesser extent, over loudspeakers, will create the perception of three-dimensionality as heard not by the listener's own ears but by those of the anthropometric model.

There are three major shortcomings of binaural recording technology:

(a) The binaural recording technology requires that the audio signals be airborne acoustical sounds that impinge upon the anthropometric model at the exact angle, depth and acoustic environment that is to be perceived relative to the model. In other words, binaural recording technology documents the dimensionality of sound sources from within existing acoustical environments.

(b) Second, binaural recording technology is dependent upon the sound transform characteristics of the human ear model utilized. For example, often it is hard for an listener to readily localize a sound source as in front or behind—there is front-to-back localization confusion. On the binaural recording array, the size and protuberance of the ears' pinna flange have a lot to do with the cuing transfer of front-to-back perception. It is very difficult to enhance the pinna effects without causing physical changes to the anthropometric model. Even if such changes are made, the front-to-back cue would be enhanced at the expense of the rest of the cuing relations.

(c) Third, binaural recording arrays are incapable of mimicking the listener's head motion utilized in the binaural localization process. Head motion by the listener is known to increase the capabilities of the sound localization system in terms of ease of localization, as well as absolute accuracy. The advantages of head motion in the sound localization task are gained by the "servo feedback" provided to the auditory system in the controlled head motion. The listener's head motion creates changes in binaural perception that disseminate additional layers of information regarding sound source position and the observed acoustical environment.

In general, binaural recording is incapable of being adapted for practical display systems—a display in which the sound source position and environmental acoustics are artificially generated and under control.

BEST MODE FOR CARRYING OUT THE INVENTION

It is an object of the present invention to provide a complex, three-dimensional auditory information display.

It is another object of my invention to provide a binaural signal processing circuit and method which is capable of processing a signal so that a localization position of the sound can be selectively moved.

It is yet a further object of the present invention to provide an artificial display that presents an enhanced perception of sound source localization in a three-dimensional space, both artificially generating the acoustical environment and emulating and enhancing binaural sound localization processing that occurs in the natural human auditory pathway.

These and other objects are achieved by the present invention of a three dimensional auditory display apparatus and method utilizing enhanced bionic emulation of human binaural sound localization for selectively giving the illusion of sound localization with respect to a listener to the auditory display. The display apparatus of the invention comprises means for receiving at least one multifrequency component, electronic input signal which is representative of one or more sound signals, front to back localization means for boosting the amplitudes of certain frequency components of said input signal while simultaneously attenuating the amplitudes of other frequency components of said input signal to selectively give the illusion that the sound source of said signal is either ahead of or behind the listener and for outputting a front to back cued signal and elevation localization means, including a variable notch filter, connected to said front to back localization means for selectively attenuating a selected frequency component of said front to back cued signal to give the illusion that the sound source of said signal is at a particular elevation with respect to the listener and to thereby output a signal to which a front to back cue and an elevational cue have been imparted.

Some embodiments further include azimuth localization means connected to the elevation localization means for generating two output signals corresponding to said signal output from the elevation localization means, with one of said output signals being delayed with respect to the other by a selected period of time to shift the apparent sound source to the left or the right of the listener, said azimuth localization means further including elevation adjustment means for decreasing said time delay with increases in the apparent elevation of the sound source with respect to the listener, said azimuth localization means being connected in series with the front to back localization means and the elevation localization means.

Further included in some embodiments are out of head localization means for outputting multiple delayed signals corresponding to said input signal, reverberation means for outputting reverberant signals corresponding to said input signal, and mixer means for combining and amplitude scaling the outputs of the out of head localization means, the reverberation means and said two output signals from said azimuth localization means to produce binaural signals. In some embodiments of the invention, transducer means are provided for converting the binaural signals into audible sounds.

In the preferred embodiment of the invention, a series connection is formed of the elevation localization means, which is connected to receive the output of the front to back localization means, and the azimuth localization means, which is connected to receive the output of the elevation localization means. The out of head localization means and the reverberation means are connected in parallel with this series connection.

In the preferred embodiment the out of head localization means and the reverberation means each have separate focus means for passing only components of the outputs of said out of head localization means and reverberation means which fall within a selected band of frequencies.

In a modified form of the invention, for special applications, separate input signals are generated by a pair of microphones separated by approximately 18 centimeters, i.e. the approximate width of a human head. Each of these input signals is processed by separate front to back localization means and elevation localization means. The outputs of the elevation localization means are used as the binaural signals. This embodiment is especially useful in reproducing the sound of a crowd or an audience.

The method according to the invention for creating a three dimensional auditory display for selectively giving the illusion of sound localization to a listener comprises the steps of front to back localizing by receiving at least one multifrequency component, electronic input signal which is representative of one or more sound signals and boosting the amplitudes of certain frequency components of said input signal while simultaneously attenuating the amplitudes of other frequency components of said input signal to selectively impart a cue that the sound source of said signal is either ahead of or behind the listener and elevational localizing by selectively attenuating a selected frequency component of said front to back cued signal to give the illusion that the sound source of said signal is at a particular elevation with respect to the listener.

The preferred embodiment comprises the further step of azimuth localizing by generating two output signals corresponding to said front to back and elevation cued signal, with one of said output signals being delayed with respect to the other by a selected period of time to shift the apparent sound source to the left or the right of the listener and decreasing said time delay with increases in the apparent elevation of the sound source with respect to the listener to impart an azimuth cue to said front to back and elevation cued signal. Out of head localizing is accomplished by generating multiple delayed signals corresponding to said input signal and reverberation and depth control is accomplished by generating reverberant signals corresponding to said input signal. Binaural signals are generated by combining and amplitude scaling the multiple delayed signals, the reverberant signals and the two output signals to produce binaural signals. These binaural signals are thereafter converted into audible sounds.

In a modified embodiment sound waves received at positions spaced apart by a distance approximately the width of a human head are converted into separate electrical input signals which are separately front to back localized and elevation localized according to the foregoing steps.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWINGS

FIGS. 8 and 9 are illustrations for use in explaining front to back cuing;

FIGS. 10 to 12 are illustrations for use in explaining elevation cuing;

FIGS. 13 to 17 are illustrations for use in explaining the principle of interaural time delays for azimuth cuing;

FIG. 18 illustrates classes of head movements;

FIG. 19 illustrates azimuth cuing using interaural amplitude differences;

DESCRIPTION OF THE PREFERRED EMBODIMENT

The human auditory system binaurally localizes sounds in complex, spherical, three dimensional space utilizing only two sound sensors and neural pathways to the brain (two eared—binaural). The listener's external auditory system, in combination with events in his or her environment, provide the neural pathway and brain with information that is decoded as a cognition of three-dimensional placement. Therefore, sound localization cuing "rules," and other limitations of human binaural sound localization are inherent within the sound processing and detection system created by the two ear, external auditory pathway and associated detection and neural decoding system leading to the brain.

By processing electronic signals representative of audible sounds according to basic human binaural sound localization "rules" the apparatus of the present invention provides artificial cuing to the listener's brain in an attempt to fool it into believing it is hearing dimensional location of sounds.

Figure 1:
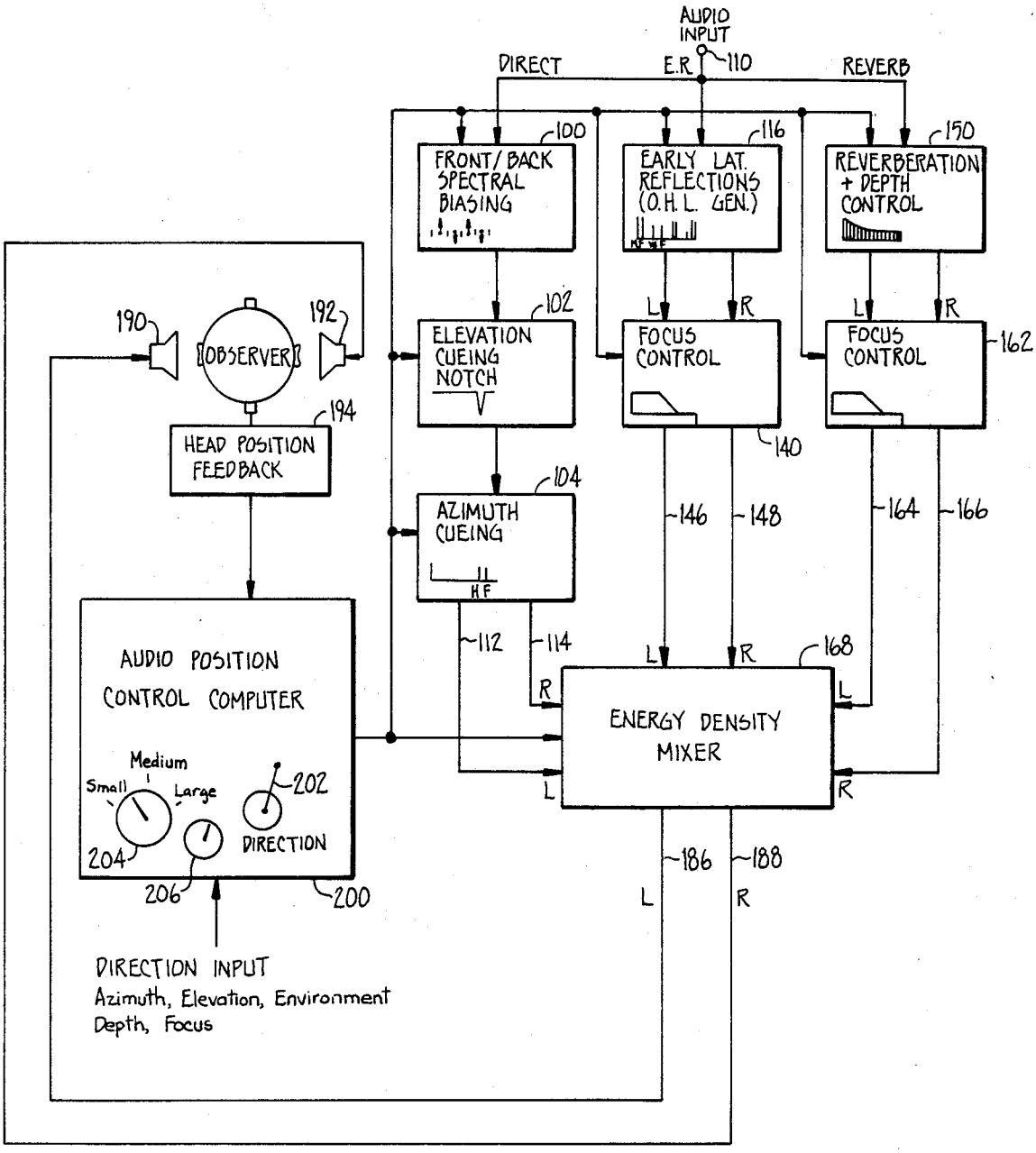
FIG. 1 is a block diagram of the circuit of my invention.

FIG. 1 is a block diagram overview of the apparatus for the generation and control of a three-dimensional auditory display. The specifications for the displayed sound image are as to its position in azimuth, elevation, depth, focus and display environment. Azimuth, elevation, and depth information can be entered into a control computer 200 interactively, such as via a joy stick 202, for example. The size of the display environment can be selected via a knob 204. The focus can similarly be adjusted via a knob 206. Optional information is provided to the audio position control computer 200 by a head position tracking system 194, providing the listener's relative head position in an absolute display environment, such as is utilized in avionics applications. The directional control information is then utilized for selecting parameters from a table of parameters stored in the memory of the audio position control computer 200 for controlling the signal processing elements to accomplish the three-dimensional auditory display generation. The appropriate parameters are downloaded from the audio position control computer 200 to the various signal processing elements of the apparatus, as will be described in more detail. Any change of position parameters is downloaded and activated in such a manner as to nearly instantaneously and without disruption, create a variance of the three-dimensional sound position image.

Figure 4:
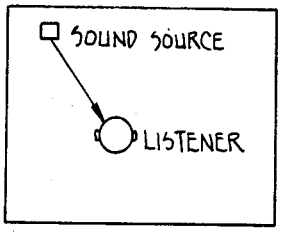
Figure 5:
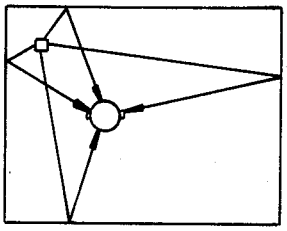
Figure 6:
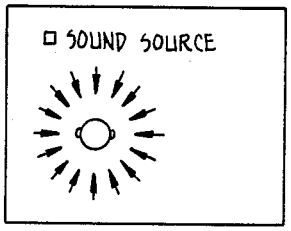
Figure 25:
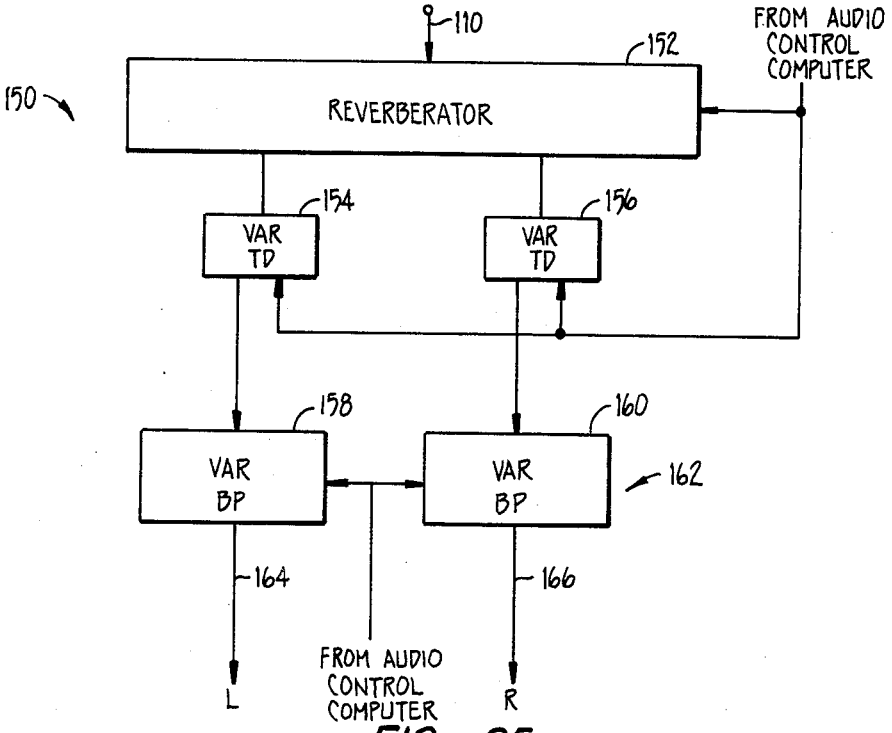
FIG. 25 is a detailed block diagram of the reverberation channel of the embodiment depicted in FIG. 1.

The audio signal to be displayed is electronically inputted into the apparatus at an input terminal 110 and split into three signal processing channels or paths: the direct sound (FIGS. 4 and 7), the early lateral reflections (FIGS. 5 and 20), and reverberation (FIGS. 6 and 25).

Figure 2:
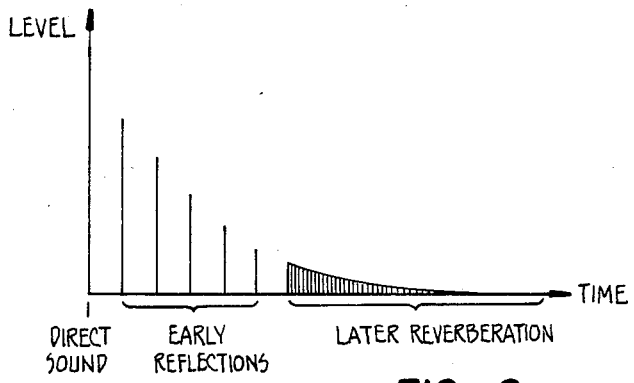
FIGS. 2 to 6 are illustrations for use in explaining the different types sounds, i.e. direct, early reflections and reverberation, generated by a source.
Figure 3:
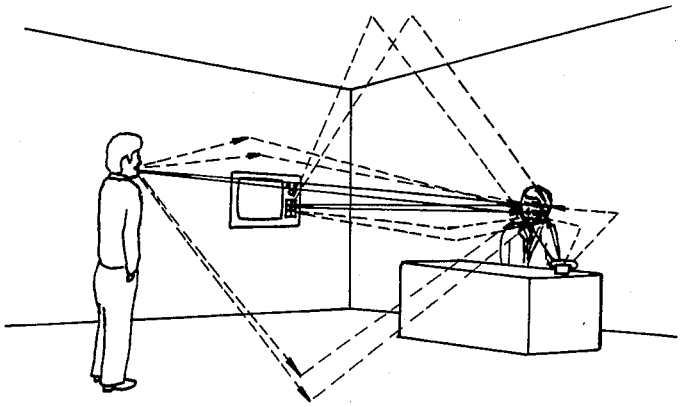

These three paths simulate the components that comprise the propagation of a sound from a source position to the listener in an acoustic environment. FIG. 2 illustrates these three components relative to the listener. FIG. 3 illustrates the multipath propagation of sound from a source to the listener and the interaction with the acoustic environment as a function of time.

Referring again to FIG. 1, the input terminal 110 receives a multifrequency component electronic signal which is representative of a direct, audible sound. Such a signal could be generated in the usual manner by a microphone placed adjacent the sound source, such as a musical instrument or vocalist, for example. By direct sound is meant that early lateral reflections of the original sound off of walls or other objects and reverberations are not present. Also not present are background sounds from other sources. While it is desireable that only the direct sound be used to generate the input signal, such other undesirable sounds may also be present if they are greatly attenuated compared to the direct sound although this renders the apparatus and process according to the invention less effective. In another embodiment to be discussed in reference to FIG. 27, however, sounds which include early reflections and reverberation can be processed using the apparatus and method of the present invention for some special purposes. Also, while it is clear that a number of such input signals representative of a plurality of different direct sounds could be fed to the same terminal 110 simultaneously, it is preferable that each such signal be separately processed.

The input terminal 110 is connected to the input of the front to back cuing means 100. As will be explained in further detail, the front to back cuing means 100 adds electronic cuing to the signal so that a listener to the sound which will ultimately be reproduced from that signal can localize the sound source as either in front of or in back of the listener.

Stereo systems or systems which have front and rear speakers with a "balance" control to attempt to vary the localization of the apparent sound source by constructing an amplitude difference between the front and rear speakers are totally unrelated to the needs and "rules" of the human auditory pathway in localizing front or back sound source position. In order for the listener's brain to be artificially fooled into localizing a sound source as being in front or back, spectral information changes must be superimposed upon the reproduced sound so as to activate the human front/back sound localization detection system. As part of the technology, artificial front/back cuing by spectral superimposition is utilized and embodied in my present invention.

It is known that some sound frequencies are recognized by the auditory system as being directional. This is due to the fact that various notches and cavities in the outer ear, including the pinna flange, have the effect of attenuating or boosting certain frequencies. Researchers have found that the brains of all humans look for the same set of attenuations and boosting, even though the ear associated with a particular brain is not even capable of fully providing that set of attenuations and boosting.

FIG. 8 represents a front to back biasing algorithm which is shown as a frequency spectrum defined as:

$$F_{point(Hz)} = e((\text{point}\# \cdot 0.555) + 4.860) \quad (1)$$

where $F_{point}$ is the frequency at a particular point at which a forward or rearward cue can be imparted, as illustrated in FIGS. 8 and 9. There are four frequency bands, as illustrated as A, B, C and D. These bands form the biasing elements of the psychoacoustics observed in nature and enhanced per this algorithm. For forward biasing, the spectrum of bands A and C is boosted and the spectral bands B and D are attenuated. For back biasing just the opposite procedure is followed. The spectrum of bands A and C are attenuated and bands B and D are boosted in their spectral content.

The point numbers as depicted on FIG. 8 represent the frequencies of importance in creating the four spectral modification bands of the front/back localizing means 100. The algorithm (1) creates a formula for the computation of the points 1 through 8 utilized in the spectral biasing and which are tabulated in FIG. 9. Point numbers 1, 3, 5, 7 and the upper end of the audio passband comprise the transition points for the four biasing band edges. The point numbers 2, 4, 6 and 8 comprise the maximum sensitivity points of the human auditory system in detecting the spectral biasing information.

The exact spectral shape and degree of attenuation or boost per biasing band is related to a large degree on application. For example, the spectrum transition from band to band will be, in general, smoother and more subtle for recording industry applications than for information display applications. The maximum boost or attenuation at point numbers 2, 4, 6 and 8 will generally range, as a minimum, from plus or minus 3 db at low frequencies, to plus or minus 6 db at high frequencies. Again, the exact shape and boost attenuation range is governed by experience with the desired application of the technology. Proper manipulation of the spectrum by filters reflecting the biasing bands of FIG. 8 and the algorithm will yield efficient generation and enhancement of front/back spectral biasing for the direct sound of FIG. 1.

Figure 7:
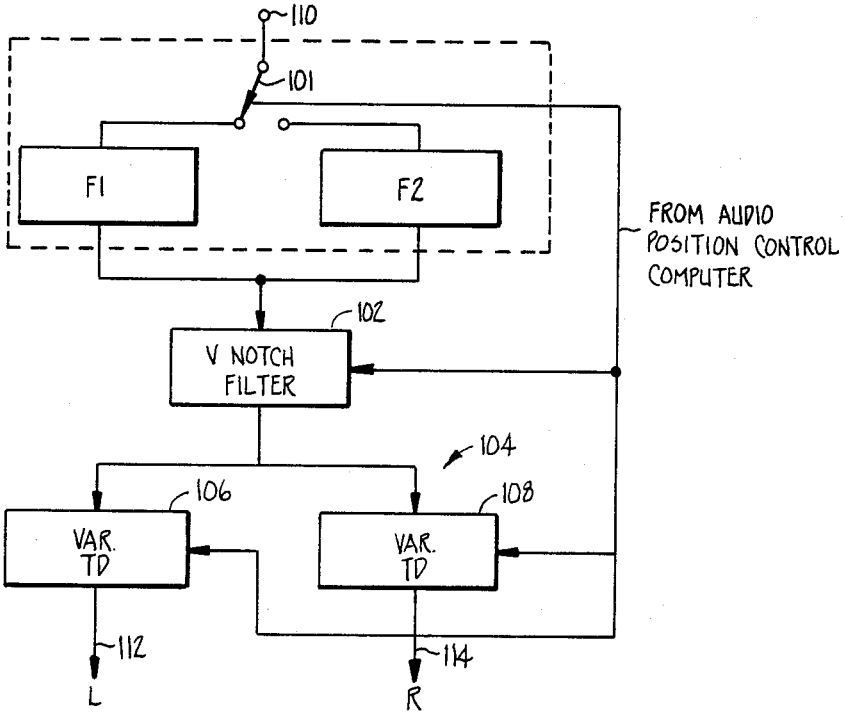
FIG. 7 is a detailed block diagram of the direct sound channel processing portion of the embodiment depicted in FIG. 1.

Referring now to FIGS. 1 and 7, the direct sound electronic input signal applied to input terminal 110 is first processed by one of two front/back spectral biasing filters F1 or F2 as selected by an electronic switch 101 under the control of the audio position control computer 200. The filters F1 and F2 have response shapes created from the spectral highlights as characterized in the algorithm (1). The filter F1 biases the sound towards the front of the listener and the filter F2 biases the sound behind the listener.

The filter F1 boosts the biasing band whose center frequencies are approximately at 392 Hz and 3605 Hz of the signal input at terminal 110 while simultaneously attenuating biasing bands whose approximate center frequencies are at 1188 Hz and 10938 Hz to impart a front cue to the signal. Conversely, by attenuating biasing bands whose approximate center frequencies are at 392 Hz and 3605 Hz while simultaneously boosting biasing bands whose approximate center frequencies are at 1188 Hz and 10938 Hz, the filter F2 imparts a rear cue to the signal.

The filters F1 and F2 are comprised of so called finite impulse response (FIR) filters which are digitally controllable to have any desired response characteristic and which do not introduce phase delays. Although the filters F1 and F2 are shown as separate filters, selected by the switch 101, in practice there would be a single filter whose response characteristic, i.e. forward or backward passband cues, is changed by data downloaded from the audio position control computer 200.

At elevation extremes (plus or minus 90 degrees), the sound image is so elevated so as to be in effect neither in front nor behind and therefore remains minimally processed by this stage.

It is known that elevational cuing can be introduced by v-notch filtering the direct sound. In a manner similar to the psychoacoustically encoding of the direct sound by the front/back spectral biasing of the first element of filtration, a second element of filtration 102 is introduced to create psychoacoustic elevation cues. The output signal from the selected filter F1 or F2 is passed through a v-notch filter 102. The audio position control computer 200 downloads parameters to control filtration of the filter 102 in order to create a spectral notch at a frequency corresponding to the desired elevation of the sound source position.

FIGS. 10 illustrates the frequency spectrum of the filter element 102 in creating a notch in the spectrum within the frequency range depicted as "E". The exact frequency center of the notch corresponds to the elevation desired and monotonically increases from 6 KHz to 12 KHz or higher to impart an elevation cue in the range of between −45° and +45°, respectively, relative to the listener's ear. The horizontal point resides at approximately 7 KHz. The exact perception of the elevation vs. notch center frequency is to some degree listener-dependent. However, in general, a notch center frequency correlates well with multi-subject observation.

The notch frequency position vs. elevation is non-linear and has greater increases in frequency steps required for corresponding positive increases in elevation. The spectral notch shape and maximum attenuation are somewhat application dependent. However, in general a 15–20 db of attenuation with a V-shaped filter profile is appropriate. A total band width of the notch should be approximately one critical band width.

FIGS. 11 and 12 show the migration of an observed spectral notch as a function of elevation with the sound source in relationship to a human ear. Notch position can be clearly seen as monotonically increasing as a function of elevation. It should be noted that a second notch can be observed in real ears corresponding to a harmonic resonance mode of the concha and antihelix cavities. Harmonic resonance modes are mechanically unpreventable in natural ears, and lead to image ghosting at a higher elevation than the primary image. Implementation of the notch filtering depicted in FIG. 10 in the architecture of FIGS. 1 and 7 enhances the localization clarity by eliminating this ghosting phenomena. Proper manipulation of the spectrum by filtration in the filter 102 will create enhanced psychoacoustic elevation cuing for the listener.

Although shown as a separate filter, the filter 102 can in practice be combined with the filters F1 and F2 into a single FIR filter whose front/back and elevational notch cuing characteristics can be downloaded from the audio position control computer 200. Thus the audio position control computer 200 can instantly control the front/back and elevational cuing by simply changing the parameters of this combined FIR filter. While other types of filters are also possible, a FIR filter has the advantage that it does not cause any phase shifting.

The third element in the direct sound signal processing chain of FIG. 1 is in the creation of azimuth vectoring by generating interaural time differences. The interaural time delays result when the same sound signal must travel further to the ear which is at the greatest distance from the source of the sound ("far" ear vs. "near" ear), as illustrated in FIGS. 13 to 15. A second algorithm is utilized in determining the time delay difference for the far ear signal:

$$T_{delay}=(4.566\cdot10^{-6}\cdot(\arcsin(\sin(Az)\cdot\cos(E1)))+(2.616\cdot10^{-4}\cdot(\sin(Az)\cdot\cos(E1))) \quad (2)$$

where Az and E1 are the angles of azimuth and elevation, respectively.

FIG. 13 illustrates a sound source and the propagation path which is created as a function of azimuth position (in the horizontal plane). Sound travels through air at approximately 1,100 feet per second; therefore, the sound that propagates from the source will first strike the near ear before reaching the far ear. When a sound is at an azimuthal extreme (90 degrees), the delay reaches a maximum of 0.67 milliseconds. Psychoacoustic studies have shown the human auditory system capable of detecting differences down to 10 microseconds.

There is a complex interaural time delay warping factor as a function of azimuth angle and elevation angle. This function is not dependent upon distance after the sound source is out in depth at over one meter. Consider the interaural time delay of a sound oriented horizontal and to the side of a human subject. At that point, the interaural time delay will be at maximum. If the sound source is elevated from the side to a position above the subject, the interaural time delay will change from maximum value to zero. Hence, elevation must be factored into the equations describing the interaural time delay as a function of azimuth change, as is seen in algorithm (2).

FIG. 16 illustrates the ambiguity of front vs. back perception for the same interaural time delay values. The same occurs along elevated points. The ambiguity has been eliminated by the psychoacoustic front/back spectral biasing and elevation notch encoding conducted in the preceding two stages of the direct sound path of FIG. 1.

This interaural time delay, as are all the localization cues discussed herein, is obviously a function of the head position relative to the location of the sound. As the listener's head rotates in a clockwise direction the interaural time delay increases if the sound location is at a point either in front of or in back of the listener, as viewed from the top (FIG. 17). Stated another way, if the sound location relative to the head is to moved from point directly in front of or in back of the listener to a point directly to one side of the listener, then the interaural time delay increases. Conversely, if the apparent location of the sound is at a point located at the extreme right of the listener, then the interaural time delay decreases as the listener's head is turned clockwise or if the apparent location of the sound moves from a point at the listener's extreme right to directly in front of or behind the listener.

As will be discussed in greater detail in a subsequent application, the rate and direction of change of the interaural time delay can be sensed by the listener as the listener's head is turned to provide further cuing as to the location of the sound. By appropriate sensors 194 affixed to the listener's head, as for example in a pilot's helmet, the rate and direction of head motion can be sensed and appropriate changes can be made in each of the cues heretofore discussed to provide additional sound localization cues to the listener.

FIG. 17 demonstrates the advantages in correcting for positional changes of the listener's head by the optional head position feedback system 194 illustrated in FIG. 1. With the listener's head motion known, the audio position control computer 200 can continuously correct for the listener's absolute head position as a function of the relative position of the generated sound image. In this way, the listener is free to move his head to take advantage of the vestibular positional feedback within the listener's brain in effectively enhancing the listener's localization ease and accuracy. As is seen in FIG. 17, a change of head position, relative to the sound source, generates opposite changes in interaural time delays for sounds from the front as opposed to the back.

Similarly, interaural time delay and elevation notch position, as illustrated in the second element processing, creates disparity upon head tipping for frontward or rearward elevated sounds.

FIG. 18 illustrates all modes of head motion that can be used to advantage in enhancing psychoacoustic display accuracy, if the head position feedback system is utilized.

FIG. 19 shows the use of interaural amplitude differences as substitutes for interaural time delays. Although interaural amplitude differences can be substituted for interaural time delays, the substitution results in an order of magnitude less sound positioning accuracy and is dependent upon sound reproduction level as well as the audio signal spectrum in the trading function.

Proper generation of interaural time differences as a function of azimuth and elevation, per algorithm (2), will result in completion of the sound position vectoring of the electronic audio signal in the direct sound signal processing chain of FIG. 1.

FIG. 7 illustrates the signal processing utilized for the generation of the interaural time delay as azimuth vectoring cue. The near ear is the right ear if the sound is coming from the right side; the near ear is left ear if the sound is coming from the left side. As depicted in FIG. 7, the far ear (opposite side to sound direction) signal is delayed by one of two variable delay units 106 or 108 which are supplied with the output of the v-notch filter 102. Which of the two delay units 106 or 108 is to be activated (i.e. the choice of which is to be the far ear) and the amount of the delay (i.e. the azimuth angle Az as illustrated in FIG. 13) is determined by the audio position control computer 200. The delay time is a function of algorithm (2), which is tabulated in FIG. 15 for representative azimuth angles. The lateralizing of the interaural time delay vectoring is not a linear function of the sound source position in relation to real heads. The outputs of the time delays 106 and 108 are taken from output leads 112 and 114, respectively.

All of the above discussed cues will merely locate the sound source relative to the listener in a given direction. Without additional cues the listener will only perceive the reproduced sound, as for example by ear phones, as coming from some point on the surface of the listener's head. To make the sound source seem to be outside of the listener's head it is necessary to introduce lateral reflections from an environment. It is the incoherence of this reflected sound relative to the primary sound which makes it seem to be coming from outside of the listener's head.

Figure 21:
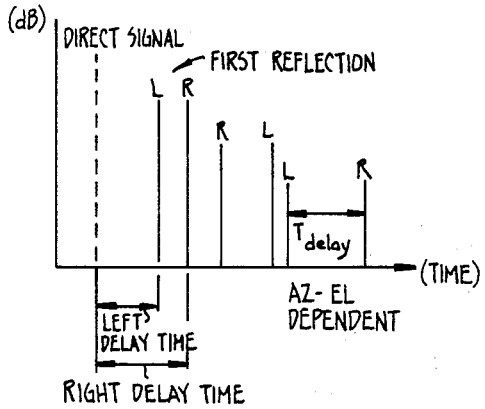
FIGS. 21, to 24 are illustrations for use in explaining early reflections as cues.

The second signal processing path for the generation of three-dimensional localization perception of the audio signal is in the creation of early reflections. FIGS. 3, 5 and 21 illustrate the initial early lateral reflection components as a function of propagation time. As a sound source generates sound in a real environment, the listener, at some distance, will first hear a direct sound as per the first signal processing path and then, as time elapses, the sound will return from the wall, ceiling and floor surfaces as reflected energy bouncing back. These early reflections are psychoacoustically not perceived as discrete echoes but as cognitive "feeling" as to the dimensions of the environment and the amount of "spaciousness" within.

Early reflections are synthetically generated in the second signal path by means of a multitude of time delay devices suitably constructed so as to generate discrete time delayed reflections as a function of the direct signal. The result of this function is illustrated in FIG. 21. There is an initial time delay until the first reflection returns from one of the surfaces. The initial time delay of the first reflection, its amplitude level and incoming direction are important in the formation of the sense of "spaciousness" and dimension. The energy level relative to the direct sound, the initial delay time and the direction must all fall under the "Haas Effect" window in order to prevent the generation of image shift or discrete echo perception.

Real psychoacoustic perception tests suggest that the best creation of spacial impression without accompanying image or sound timbre distortions is in returning the first reflection within the 30 to 60 millisecond time frame. The first reflection, and all subsequent reflections, must be directionally vectored as a function of return angle to the listener of the reflected energies in much the same manner as the direct sound in the first signal processing chain. However, in practice, for the sake of processing economy and in regard to practical psychoacoustics, the modeling need not be so complex. As will be seen in the next element of the signal path for early reflections, the focus control 140 will often filter the spectrum of the early reflections severely enough to eliminate the need for front/back spectral biasing or elevation notch cues. The only necessary task is in the generation of an interaural time delay component between the near and far ear in order to vectorize the azimuth and elevation of the reflection. This should be done in accordance with algorithm (2).

Although less effective, interaural amplitude differences could be substituted for the interaural time delays in some applications. The exact time delay, amplitude and direction of subsequent early reflections and the number of discrete reflections modeled, is very complex in nature, and cannot be fully predicted.

Figure 22:
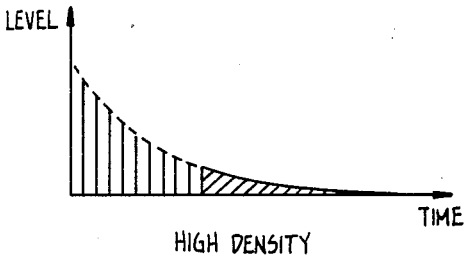
Figure 23:
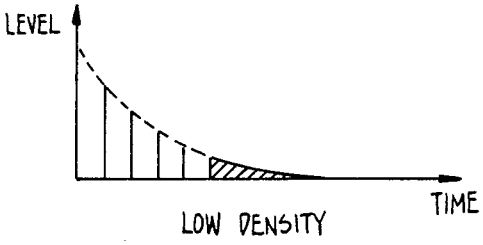

As FIGS. 22 and 23 illustrate, different early reflection densities are created dependent upon the size of the environment. FIG. 22 represents a high density of reflections, common in small rooms, while FIG. 23 is more realistic of larger rooms wherein discrete reflections take longer propagation paths.

The linear time return of reflections in FIGS. 22 and 23 is not to imply an orderly return as optimal. Some applications, such as real room modeling, will result in significantly more unorderly and "bunched" reflection times.

The exact modeling of the density and direction of the early reflection components will significantly depend on the application of the technology. For example, in recording industry applications it may be desirable to convey a good sense of the acoustic environment in which the direct sound is placed. The modes of reflection within a given acoustic environment depend heavily upon the shape, orientation of source to listener, and acoustical damping factors within. Obviously, the acoustics of a shower stall would have high early reflection density and level in comparison to a concert hall. Practitioners of architectural acoustic modeling are quite able to model the exact time delay, direction, amplitude, etc. of early reflection components adequate for use in the early reflection generating means. Those practiced within the industry will use mirror image reflection source modeling as a means of accomplishing the proper early reflection time sequence. In other applications, such as in avionics displays, it may not be necessary to create such an exacting model of realistic acoustic environments. In fact, it might be more important to generate the cognition of maximum "spaciousness."

In overview, the more energy that is returned from the lateral directions (from the listener's sides) during the early reflection period, the more "spaciousness" is perceived by the listener. The "spaciousness" trade off is complex, dependent upon the direction of the early reflections. It therefore is important in the creation of "spaciousness" and spatial impression to generate early reflections with as much lateralization as possible—best created through large interaural time delays (0.67 milliseconds maximum).

The higher the lateral energy fraction in the early reflections, the greater the spatial impression; hence, the designation early lateral reflections is a bit more significant for a number of applications of this element of the second signal processing chain. Of most significance, in terms of the importance of early reflections, is the creation of "out of head localization" of the direct sound image. Without the sense of "spaciousness" and environment generated by the early reflection energy fraction, the listener's brain seems to have no sense of reference for the direct sound. It is a common occurrence for early reflection energy to exceed direct sound energy for successful out of head localization creation. Therefore, without early reflecting energy fractions "supporting" out of head localization, the listener will have a sense, particularly when headphones are used for sound reproduction, of the direct sound as being perceived as vectored in direction, but unfortunately "right on the skull" in terms of depth. Therefore, early reflection modeling and its importance in the creation of out of head localization of the direct sound image, is crucial for proper display creation.

Figure 20:
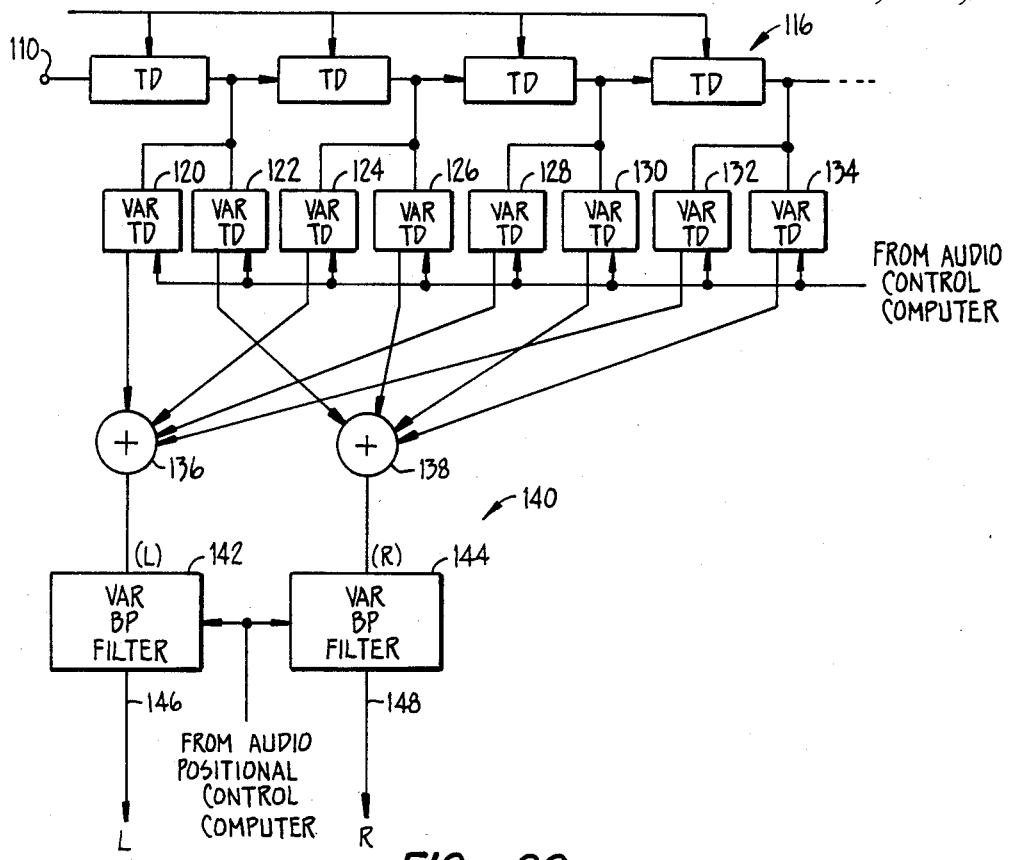
FIG. 20 is a detailed block diagram of the early reflection channel of the embodiment depicted in FIG. 1.

Referring now more particularly to FIG. 20, the apparatus for carrying out the out of head localization cuing step is illustrated. The audio input signal from input terminal 110 is supplied to an out of head localization generator 116 ("OHL GEN") comprised of a plurality of time delays (TD) 118 connected in series. The delay amount of each time delay 118 is controlled by the audio position control computer 200. The output of each time delay 118, in addition to being connected to the input of the next successive time delay 118, is connected to the inputs of separate pairs of interaural time delay circuits 120, 122; 124, 126; 128, 130; and 132, 134. The pairs of interaural time delay circuits 120–134, inclusive, operate in substantially the same manner as the circuit 104 of FIG. 7 to impart an azimuth cue, i.e. an interaural time delay, to each delayed version of the signal input at the terminal 110 and output from the respective delay units 120–134. The audio position control computer 200 downloads the time delay, computed according to algorithm (2), for each delay unit pair. The delays, however, are preferably random with respect to each pair of delay units. Thus, for example, the output of the first delay unit 118 may have an azimuth cue imparted to it by the delay units 120 and 122 to make it seem to be coming from the extreme left of the listener (i.e. the delay 120 unit adds a 0.67 millisecond delay to the signal input to it compared to the signal passed by the delay unit 122 without any delay) whereas the output of the second time delay unit 118 may have an extreme right cue imparted to it by the delay units 124 and 126 (i.e. the delay unit 126 adds a 0.67 millisecond delay to the signal passing through it and the delay unit 124 adds no delay).

The outputs of the delay units 120, 124, 128 and 132 are supplied to a scaling and summing junction 136. The outputs of the delay units 122, 126, 130 and 134 are supplied to a scaling and summing junction 138. The outputs of the junctions 136 and 138 are left (L) and right (R) signals, respectively, which are supplied to the corresponding inputs of the focus control circuit 140, whose function will now be discussed.

Figure 24:
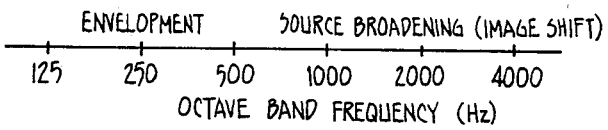

The second element of the second signal processing chain is in changing the energy spectrum of the early reflections in order to maintain the desired "focus" of the direct sound image. As can be seen in FIG. 24, if the early reflection components are filtered to provide energy in the low frequency spectrum, the sensation of "spaciousness" created by the early reflections provides the cognition of "envelopment" by the sound field. If the early reflection spectrum includes components in the mid frequency range, the direct sound is diffused laterally and "de-focused" or broadened. And, as more and more high frequency components are included, more and more of the image is drawn laterally and literally displaces the image. Therefore, by changing the early reflection spectrum (in particular, low pass filtering), the direct sound image can be influenced, at will, to change from a coherently localized sound image to a broadened image.

Again referring to FIG. 20, the focus control circuit 140 is comprised of two variable band pass filters 142 and 144 which are supplied with the L and R signal outputs of the summing junctions 136 and 138, respectively. The frequency bands which are passed by the filters 142 and 144 to the respective output leads 146 and 148 are controlled by the audio position control computer 200. Thus by bandpass filtering the L and R outputs to limit the frequency components to 250 Hz, plus or minus 200 Hz, a cue of envelopment is imparted. If the frequency components are limited to 1.5 KHz, plus or minus 500 Hz, a cue of source broadening is imparted and if limited to 4 KHz and above a displaced image cue is imparted.

As an example of the purpose of the focus control 140, in recording industry applications, it may be desirable to slightly broaden the image for a "fuller sound." To do this the audio position control computer 200 will cause the filters 142 and 144 to pass primarily energy in the low frequency spectrum. In avionic displays it is more important to keep finer "focus" for exacting localization accuracy. In such applications the audio position control computer 200 will cause the filters 142 and 144 to pass less of the low frequency energy.

Figure 26:
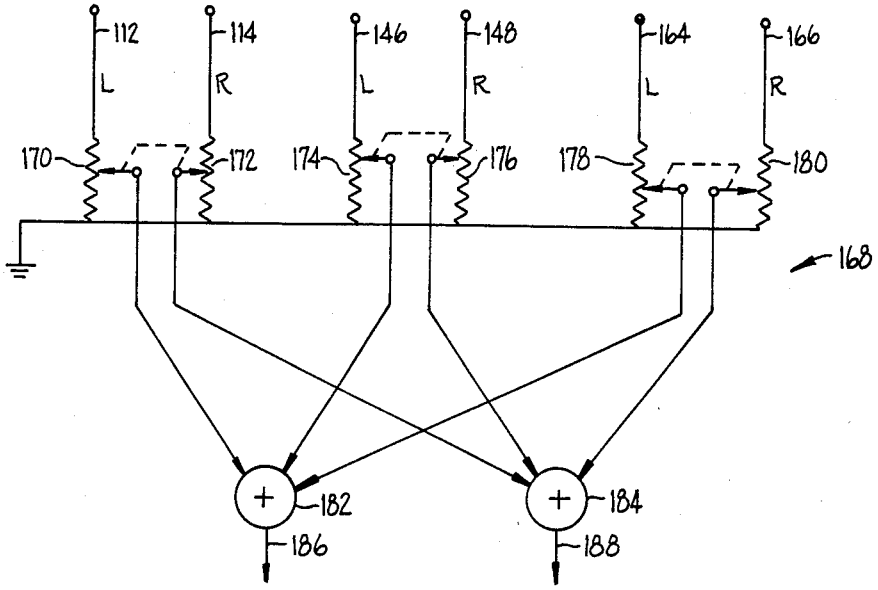
FIG. 26 is a detailed block diagram of the energy density mixer portion of the embodiment depicted in FIG. 1.

Of course, whenever focus control is changed, the early reflection energy fraction will also change. Therefore, the energy density mixer 168 in FIG. 1 will have to be readjusted by the audio position control computer 200 so as to maintain proper spatial impression and out of head localization energy ratios. The energy density mixer 168, as illustrated in FIGS. 1 and 26, carries out the ratiometric mixing separately within each channel, so as to always keep right ear information separated from left ear information display components.

Generating early reflections, and particularly early lateral reflections, and focusing the reflection bandwidth by the second signal processing chain, creates energy delayed in time relative to the direct sound with which it is mixed in the energy density mixer 168. The addition of "focused" early reflections has created the sensation of "spaciousness" and out of head localization for the listener.

The third signal processing path in FIG. 1, used in the generation of three-dimensional localization perception of the audio signal, is in the creation of reverberation. FIGS. 2 and 6 illustrate the concept of reverberation in relationship to the direct sound and the early reflections generated within a real acoustic environment. The listener, at some distance from the sound source, first hears the primary sound, the direct sound, as was modeled in the first signal processing path. As time continues, secondary energy in the form of early reflections returns from the acoustic environment, in an orderly fashion after being reflected from its surfaces. The listener can sense the secondary reflections in regard to their direction, amplitude, quality and propagation time, forming a cognitive image of the acoustic environment. After one or two reflections within the acoustic environment for all the reflected components, this secondary energy becomes extremely diffuse in terms of the reflected energy direction and reflected energy order returning within the acoustic environment. It becomes impossible for the listener to sense the direction of individual reflected energies; the energy is sensed as coming from all around. This is the tertiary energy known as reverberation.

Those practiced within the field of psychoacoustics and the construction of psychoacoustic apparatus for practical application, will have suitable knowledge for the design and construction of reverberation generators suitable for the first element of the third signal processing chain in FIG. 1. However, there is a constraint which needs to be imposed on the output stage of the reverberation generator. The output of the reverberator must be as incoherent as possible in terms of its returning energy direction and order. Again, direction vectoring for reflection components can be modeled as complexly as the entire direct sound signal processing chain in FIG. 1.

In practice, however, for the sake of processing economy and in regard to practical psychoacoustics, the modeling need not be so complex because the next element of the third signal processing chain of FIG. 1, the focus control 162, will often filter the spectrum of the reverberation severely enough so as to eliminate the need for front/back spectral biasing or elevation notch cues. The only necessary task at the output of the reverberation generator is in creating interaural time delay components between the near ear and the far ear in order to vectorize the direction of the incoming energies.

The direction vectorization by interaural time delays can be modeled in a very complex manner, such as modeling the exact return directions and vectorizing their returns; or it can be modeled simply, such as by creating a number of pseudo-random interaural time delays by simple delay elements at the output of the reverberation generator. Such delays can create random or pseudo- random vectoring between the range of 0 to 67 milliseconds at the far ear.

With reference now to FIG. 25, the reverberation and depth control circuit 150 comprises a reverberator 152, such as a Yamaha model DSP-1 Effects Processor, which outputs a plurality of signals which are delayed and redelayed versions of the signal input at terminal 110. Only two outputs are shown, but it is to be understood that many more outputs are possible depending upon the particular model of reverberator used. Each of the outputs of the reverberator 152 is supplied to a separate delay unit 154 or 156. The output of the left delay unit 154 is connected to the input of a variable bandpass filter 158 and the output of the right delay unit 156 is connected to the input of a variable bandpass filter 160.

The reverberator 152 and the delay units 154 and 156 are controlled by the audio position control computer 200. The purpose of the delay units 154 and 156 is to vectorize the direction by introducing interaural time delays. As explained above, it is important to vectorize the direction of the incoming components in a random fashion so as to create the perception of the tertiary energy as being diffuse. Thus the computer 200 is constantly changing the amounts of the delay times. Interaural time delays are the most suitable means of vectorizing the direction, but in some applications it may be suitable to use interaural amplitude differences, as was discussed above.

In a standard reverberation decay curve (on average) for the output of a suitable reverberation generator, the reverberation time is measured in terms of a 60 db decay of level and can range from 0.1 to 15 seconds in practice. Reverberation energies reflected off the surfaces of the acoustic environment will have a high reverberation density in small environments, wherein the reflection path propagation time is short; whereas the density of reverberation in large environments is lower due to the long individual reflection and propagation paths. This parameter needs to be varied in accordance to the acoustic environment being modeled.

There is a damping effect vs. frequency that tends to occur with reverberation in real acoustic environments. Every time acoustic energy is reflected from a real surface, some portion of that energy is dissipated as heat—there is an energy loss. However, the energy loss is not uniform over the audible frequency spectrum; whereas low frequency sounds tend to be reflected almost perfectly, high frequency energy tends to be absorbed by fibrous materials, etc. much more readily. This tends to make the decay time of the reverberation shorter at high frequencies than at low frequencies. Additionally, propagation losses in sound traveling through air itself can lead to losses of high and even low frequency components of the reverberation within large acoustic environments. In fact, the parameter of reverberation damping factors can be adjusted to advantage for keeping the high frequency components under more severe control, accomplishing better "focus."

The outputs of the variable time delay units 154 and 156 are filtered in order to achieve focus control of the direct sound. Again referring to FIG. 25, this filtering is accomplished by variable bandpass filters 158 and 160, which constitute the focus control 162. The audio position control computer 200 causes the filters to select the desired bandpass frequency. The outputs 164 and 166 of the band pass filters 158 and 160, respectively, are supplied to the mixer 168 as the left (L) and right (R) signals.

This focus control stage 162 may in fact be unnecessary, depending upon the reverberation starting time in relationship to when the early reflections ended, the spectral damping factor for the reverberation components, etc. However, it is generally deemed to be advantageous to contain the spectral content of the reverberation energy. The advantages of focus control upon the direct sound have been discussed above.

An important factor of the system is depth perception control of the direct sound image within an acoustic environment. The deeper that a sound source is placed within a reverberant environment, relative to the listener, the lower in amplitude will be the direct sound in comparison to the early reflection and reverberant energies.

The direct sound tends to decrease in amplitude by 6 db per doubling of distance from the listener. In linear scale, the decay is proportional to the inverse square of the distance away. While less of the total sound source energy reaches the listener directly, the reflection of those energies within the environment tends to integrate over time to the same level. Therefore, psychoacoustically, the listener's mind takes note of the energy ratio between the direct sound and the early reflection and reverberant components in determining distance. To further illustrate, as a sound source is moved in distance from the listener to deep within the environment, the listener's psychoacoustic sensation will be one of having much of the early reflection and reverberation energy "masked" by the loudness of the direct sound when nearby—to hearing mostly reflected components almost "masking out" the direct sound when the direct sound is at some distance.

The energy density mixer 168 in FIG. 1 is used to vary the proportions of direct sound energy, early reflection energy and reverberant energy so as to create the desired position of the direct sound in depth within the illusionary environment. The exact proportion of direct sound to the reflected components is best determined by experimentation for determining depth placement; but, in general, it remains a monotonic decreasing function per increase of depth.

Referring now to FIG. 26, the mixer 168 is shown, for purposes of illustrating its operation, to be comprised of three pairs of potentiometers 170, 172; 174, 176; and 178, 180. In the actual practice the mixer could be constructed of scaling summing junctions or variable gain amplifiers configured to produce the same results. The potentiometers 170, 172; 174, 176; and 178, 180 are connected, respectively, between the circuit ground and the separate outputs 112, 114; 146, 148; and 164, 166. Each pair of potentiometers has their wiper arms mechanically ganged together to be movable in common, either under manual control or under the control of the audio position control computer 200. The wiper arms of the potentiometers 170, 174, and 178 are summed at a summing junction 182 whose output 186 constitutes the left binaural output signal of the apparatus. The wiper arms of the potentiometers 172, 176 and 180 are electrically connected together and constitute the right binaural output signal 184 of the apparatus. In operation, the relative positions of the potentiometer pairs are varied to selectively adjust the ratio of direct sound energy (on leads 112 and 114) in proportion to the early reflection (on leads 146 and 148) and reverberant energy (on leads 164 and 166) in order to create the desired position of the direct sound in depth within the illusionary environment.

There is a secondary phenomena of depth placement—as the direct sound image is placed further and further in depth within the illusionary environment, the exact localization of its position becomes more and more diffuse in origin. Therefore, the further the direct sound resides from the listener in the reverberant field, it—like the reverberant field—will become more and more diffuse as to its origin.

As mentioned above, all of the foregoing cuing units 100, 102, 104, 116, 140, 150, 162 and 168 operate under the control of the audio position control computer 200, which can be a programmed microprocessor, for example, which simply downloads from a table of predetermined parameters stored in memory the required settings for each of these cuing units as selected by an operator. The operator selections can be input to the audio position control computer 200 by a program stored in a recording media or interactively via the controls 202, 204 and 206.

Ultimately the binaural signals output from the mixing means 168 on leads 186 and 188 will be audibly reproduced by, for example, speakers or earphones 190 and 192 which are preferably located on opposite sides of the listener, although in the usual application the signals would first be recorded along with many other binaural signals and then mastered into a binaural recording tape for making records, tapes, sound films or optical disks, for example. Alternatively, the binaural signals could be transmitted to stereo receivers, such as stereo FM receivers or stereo television receivers, for example. It will be understood, then, that the speakers 190 and 192 symbolically represent these conventional audio reproduction steps and apparatus. Furthermore, although only two speakers 190 and 192 are shown, in other embodiments more speakers could be utilized. In such case, all of the speakers on one side of the listener should be supplied with the same one of the binaural signals.

Figure 27:
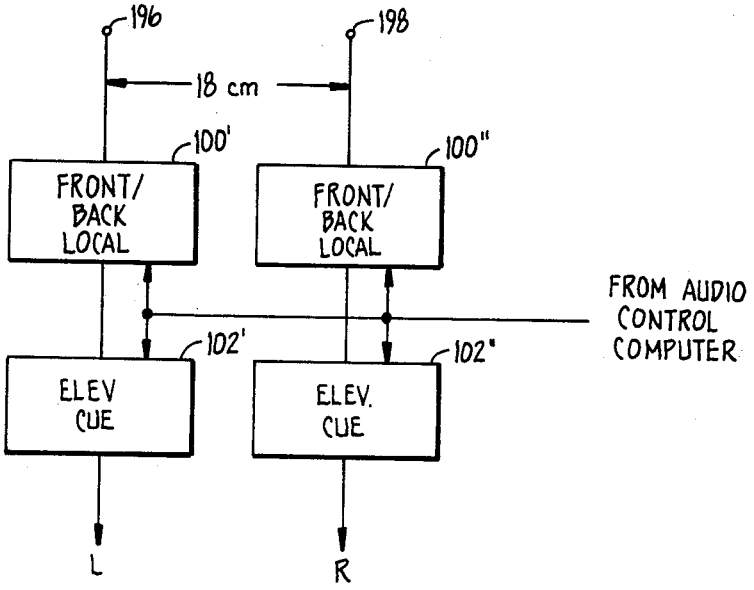
FIG. 27 is a block diagram of still another embodiment of the invention.

Referring now to FIG. 27 still another embodiment is disclosed. This embodiment has special applications, such as producing binaural signals which reproduce sounds of crowds or groups of people. In this embodiment a pair of omnidirectional or cardioid microphones 196 and 198 are mounted spaced apart by about 18 centimeters, the approximate width of a human head. The microphones 196 and 198 transduce the sounds at those locations and produce corresponding electrical input signals to separate direct sound processing channels comprised of front to back localization means 100' and 100'' and separate elevational localizing means 102' and 102'' which are constructed and controlled in the same manner as their counterparts depicted in FIGS. 1 and 20 and identified by the same reference numerals, unprimed.

In operation, the sounds arriving at the microphones 196 and 198 already contain lateral early reflections, reverberations, and are focussed due to the effects of the actual environment surrounding the microphones 196 and 198 in which the sounds are produced. The spacing of the microphones introduces the interaural time delay between the L and R output signals. This embodiment is similar to the prior art anthropometric model systems discussed at the beginning of this specification except that front to back and elevation cuing are electronically imparted. With prior art model systems of this type, to change the front to back cuing or elevational cuing, it was necessary to construct model ears around the microphones to provide the cuing. As also mentioned above, such prior art techniques were not only cumbersome but often derogated from other desired cues. This embodiment allows front to back and elevation cuing to be quickly and easily selected. The apparatus has application, for example, in the case of stereo television to make the audience sound as though it is in back of the television viewer. This is done simply by placing the spaced apart microphones 196 and 198 in front of the live audience (or using a stereo recording taken from such microphones placed before an audience), separately processing the sounds using the separate front to back localizing means 100' and 100'' and the elevation localizing means 102' and 102'' and imparting the desired location cues, e.g. in back of and slightly higher than a listener properly placed between the stereo television speakers, such as speakers 190 and 192 of FIG. 1. The listener then hears the sounds as though he or she is sitting in the front of the television audience.

Although the present invention has been shown and described with respect to preferred embodiments, various changes and modifications which are obvious to a person skilled in the art of which the invention pertains are deemed to lie within the spirit and scope of the invention.

What is claimed is:

1. A three dimensional auditory display apparatus for selectively giving the illusion of sound localization to a listener comprising means or receiving at least one multifrequency component, electronic input signal which is representative of one or more sound signals, front to back localization means for boosting the amplitudes of certain frequency components of the amplitudes of other frequency components of the input signal to selectively give the illusion that the sound source of the signal is positioned either ahead of or behind the listener and for thereby outputting the input signal with a front to back cue;

elevation localization means, including a variable notch filter, connected to the front to back localization means for selectively attenuating a selected frequency component of the front to back cued signal to give the illusion that the sound source of the signal is at a particular elevation with respect to the listener and to thereby output a signal to which a front to back cue and an elevational cue have been imparted; and azimuth localization means connected to the elevation localization means for generating two output signals corresponding to the front to back and elevation cued signal output from the elevation localization means, with one of the two output signals being delayed with respect to the other by a selected period of time to shift the apparent location of the sound source to the left or the right of the listener, the azimuth localization means further including elevation adjustment means for decreasing the time delay with increases in the apparent elevation of the sound source with respect to the listener, the azimuth location means being connected in series with the front to back localization means and the elevation localization means.

2. A three dimensional auditory display apparatus as recited in claim 1 wherein the elevation adjustment means varies the time delay according to the function:

$$T_{delay}=(4.566\cdot10^{-6}\cdot(\arcsin(\sin(Az)\cdot\cos(E1))))+(2.616\cdot10^{-4}\cdot(\sin(Az)\cdot\cos(E1))))$$

where Az and E1 are the angles of azimuth and elevation, respectively, of the sound source with respect to the listener.

3. A three dimensional auditory display apparatus as recited in claim 1 further comprising out of head localization means for outputting multiple delayed output signals corresponding to the input signal, reverberation means for outputting reverberant signals corresponding to the input signal, and mixer means for combining and amplitude scaling the outputs of the out of head localization means, the reverberation means and the two output signals from the azimuth localization means to produce binaural signals.

4. A three dimensional auditory display apparatus as recited in claim 3 further comprising transducer means for converting the binaural signals into audible sounds.

5. A three dimensional auditory display apparatus as recited in claim 1 wherein the azimuth localization means selectively delays one of the two output signals relative to the other output signals between 0 and 0.67 milliseconds.

6. A three dimensional auditory display apparatus as recited in claim 3 wherein the reverberation means selectively outputs signals corresponding to the input signal but delayed in the range of between 0.1 and 15 seconds.

7. A three dimensional auditory display apparatus as recited in claim 3 further comprising at least one focus means supplied with at least one of the outputs of the out of head localization means or the reverberation means for selectively bandpass filtering the supplied output to limit the frequency components to 250 Hz, plus or minus 200 Hz to impart a cue of envelopment, to 1.5 KHz, plus or minus 500 Hz to impart a cue of source broadening, and to 4 KHz and above to impart a displaced image cue.

8. A three dimensional auditory display apparatus as recited in claim 3 wherein the out of head localization means further comprises means for introducing separate, selected interaural time delays for each of the multiple delayed output signals.

9. A three dimensional auditory display apparatus as recited in claim 3 wherein the input signal is representative of a direct sound signal.

10. A three dimensional auditory display apparatus for selectively giving illusion of sound localization to a listener comprising means for receiving at least one multifrequency component, electronic input signal which is representative of one or more sound signals, front to back localization means for selectively boosting biasing bands whose center frequencies are approximated at 392 Hz and 3605 Hz of the biasing bands whose center frequencies are approximated at 1188 Hz and 10938 Hz to introduce a front cue to the biasing bands whose center frequencies are approximated at 392 Hz and 3605 Hz of the electronic input signal while simultaneously boosting biasing bands those center frequencies are approximated at 1188 Hz and 10938 Hz to introduce a rear cue to the electronic input signal, the front to back localization means thereby outputting a front to back cued signal; and elevation location means, including a variable notch filter, connected to the front to back localization means for selectively attenuating a selected frequency component of the front to back cued signal to give the illusion that the sound source of the signal is at a particular elevation with respect to the listener and to thereby output a signal to which a front to back cue and an elevational cue have been imparted.

11. A three dimensional auditory display apparatus as recited in claims 1 or 10 wherein the front to back location means comprises a finite impulse filter.

12. A three dimensional auditory display apparatus as recited in claims 1 or 10 wherein the elevation localization means attenuates a selected frequency component within a range of between 6 KHz and 12 KHz to impart an elevation cue in the range of between −45° and +45°, respectively, relative to the listener's ear.

13. A three dimensional auditory display apparatus as recited in claims 1 to 10 further comprising a pair of front to back localization means and a pair of elevation localization means and further comprising a pair of microphones spaced apart by the approximate width of a human head, each of the microphones producing a separate electronic input signal which is supplied to a different one of the front to back localization means, whereby the outputs of the pair of elevation localization means constitute binaural signals.

14. A method of creating a three dimensional auditory display for selectively giving the illusion of sound localization to a listener comprising the following steps:

front to back localizing by receiving at least one multifrequency component, electronic input signal which is representative of at least one sound signal and boosting the amplitudes of certain frequency components of the input signal while simultaneously attenuating the amplitudes of other frequency components of the input signal to selectively produce a front to back cued signal giving the illusion to the listener that the sound source is either ahead of or behind the listener and elevational localizing by selectively attenuating a selected frequency component of the front to back cued signal to produce a front to back and elevation cued signal giving the illusion that the sound source of the signal is at a particular elevation with respect to the listener; and azimuth localizing by generating two output signals corresponding to the front to back and elevation cued signal, with one of the output signals being delayed with respect to the other by a selected period of time to shift the apparent sound source to the left or the right of the listener and decreasing the time delay with increases in the apparent elevation of the sound source with respect to the listener to impart an azimuth cue to the front to back and elevation cued signal.

15. A method of creating a three dimensional auditory display for selectively giving the illusion of sound localization to a listener comprising the following steps:

front to back localizing by receiving at least one multifrequency component, electronic input signal which is representative of at least one sound signal and selectively boosting biasing bands whose center frequencies are approximated at 392 Hz and 3605 Hz of the signal while simultaneously attenuating biasing bands whose center frequencies are approximated at 1188 Hz and 10938 Hz and selectively attenuating biasing bands whose center frequencies are approximated at 392 Hz and 3605 Hz of the signal while simultaneously boosting biasing bands whose center frequencies are approximated at 1188 Hz and 10938 Hz to selectively produce a front to back cued signal which imparts to the listener the illusion that the sound source of the signal is either ahead of or behind the listener; and elevational localizing by selectively attenuating a selected frequency component of the front to back cued signal to give the illusion that the sound source of the signal is at a particular elevation with respect to the listener.

16. A method of creating a three dimensional auditory display as recited in claims 14 or 15 wherein the elevation localizing step comprises the step of attenuating a selected frequency component within a range of between 6 KHz and 12 KHz to impart an elevation cue in the range of between −45° and +45°, respectively, relative to the listener's ear.

17. A method of creating a three dimensional auditory display as recited in claims 14 or 15 comprising the further steps of transducing sound waves received at a positions spaced apart by a distance approximately the width of a human head into separate electrical input signals and separately front to back localizing and elevation localizing each of the separate input signals.

18. A method of creating a three dimensional auditory display as recited in claims 14 or 15 wherein the input signal is representative of a direct sound.

19. A method of creating a three dimensional auditory display as recited in claim 16 comprising the further steps of:

out of head localizing by generating multiple delayed signals corresponding to the input signal;

imparting reverberation and depth control by generating reverberant signals corresponding to the input signal; and binaural signal generation by combining and amplitude scaling the multiple delayed signals, the reverberant signals and the two output signals to produce binaural signals.

20. A method of creating a three dimensional auditory display as recited in claim 19 further comprising the step of converting the binaural signals into audible sounds.

21. A method of creating a three dimensional auditory display as recited in claim 19 wherein the step of imparting reverberation comprises the step of generating signals corresponding to the input signal but delayed in the range of between 0.1 and 15 seconds.

22. A method of creating a three dimensional auditory display as recited in claim 14 wherein in the azimuth localizing step the time delay is determined according to the function:

$$T_{delay}=(4.566\cdot10^{-6}\cdot(\arcsin(\sin(Az)\cdot\cos(E1))))+(2.616\cdot10^{-4}\cdot(\sin(Az)\cdot\cos(E1)))$$

where Az and E1 are the angles of azimuth and elevation, respectively.

23. A method of creating a three dimensional auditory display as recited in claim 14 wherein the azimuth localizing step comprises the step of selectively delaying one of the two output signals relative to the other output signal between 0 and 0.67 milliseconds.

* * * * *

UNITED STATES PATENT AND TRADEMARK OFFICE

CERTIFICATE OF CORRECTION

PATENT NO. : 4,817,149

DATED : March 28, 1989

INVENTOR(S) : Peter H. Myers

It is certified that error appears in the above-identified patent and that said Letters Patent is hereby corrected as shown below:

In Col. 15, line 58, delete "67" and insert --0.67--;

In Col. 19, line 18, delete "or" and insert --for--;

In Col. 19, line 23, delete "amplitudes of other frequency components of the";

In Col. 19, line 24, delete "signal to" and insert --signal while simultaneously attenuating the amplitudes of other frequency components of the input signal to--;

In Col. 20, line 36, delete "giving illusion" and insert --giving the illusion--;

In Col. 20, line 43, delete "the biasing" and insert --the electronic input signal while simultaneously attenuating biasing--;

In Col. 20, line 46, delete "the biasing" and insert --the electronic input signal and selectively attenuating biasing--;

In Col. 20, line 54, delete "location" and insert --localization--;

UNITED STATES PATENT AND TRADEMARK OFFICE

CERTIFICATE OF CORRECTION

PATENT NO. : 4,817,149

DATED : March 28, 1989

INVENTOR(S) : Peter H. Myers

It is certified that error appears in the above-identified patent and that said Letters Patent is hereby corrected as shown below:

In Col. 22, line 17, delete "a" at the end of the line.

Signed and Sealed this

Twelfth Day of June, 1990

*Attest:*

HARRY F. MANBECK, JR.

*Attesting Officer*

*Commissioner of Patents and Trademarks*